US006247250B1

(12) United States Patent
Hauser

(10) Patent No.: US 6,247,250 B1
(45) Date of Patent: Jun. 19, 2001

(54) CONFORMABLE SHOE INSERT WITH A SUPPORT LAYER

(76) Inventor: John P. Hauser, 1160 Bower Hill Rd., Apt. 1100B, Pittsburgh, PA (US) 15243

( * ) Notice: Subject to any disclaimer, the term of this patent is extended or adjusted under 35 U.S.C. 154(b) by 0 days.

(21) Appl. No.: 09/382,104

(22) Filed: Aug. 24, 1999

Related U.S. Application Data

(63) Continuation-in-part of application No. 09/087,722, filed on May 29, 1998, now abandoned, which is a continuation-in-part of application No. 08/291,008, filed on Aug. 15, 1994, now abandoned.

(51) Int. Cl.[7] ..... A43B 13/40

(52) U.S. Cl. ..... 36/44; 36/80; 36/154; 36/173; 36/174; 36/181

(58) Field of Search ..... 36/91, 71, 80, 36/145, 154, 166, 173, 174, 180, 181, 44

(56) References Cited

U.S. PATENT DOCUMENTS 1,828,086 * 10/1931 Tweedie .
1,992,081 * 2/1935 Madinger .
2,826,834 * 3/1958 Ratcliff .
4,782,605 * 11/1988 Chapnick .
4,862,604 * 9/1989 Hauser .
5,170,572 * 12/1992 Kantro .

* cited by examiner

*Primary Examiner*—Ted Kavanaugh
(74) *Attorney, Agent, or Firm*—Dougherty & Clements LLP

(57) ABSTRACT

A shoe insert includes a support layer having a bottom surface and a top surface opposing the bottom surface. The shoe insert further includes a cushion layer fixedly superposed onto the top surface of the support layer. The bottom surface includes a generally planar distal portion, a proximal portion and a medial portion interconnecting the distal portion and the proximal portion. The distal portion cushions the toes and the ball of the foot. The proximal portion supports the heel of the foot and has a centrally disposed depression concave and a generally planar border located posteriorly with respect to the centrally disposed concave depression. The centrally disposed concave depression and border together produce a medial and lateral wedging effect against the heel of the foot. The medial portion supports the mid-region of the foot. The medial portion includes a centrally disposed, generally planar raised portion, a first depression for supporting the medial arch of the foot, a second depression for supporting the lateral arch of the foot, and a third depression for supporting the metatarsal arch of the foot. In use, natural foot warmth causes the support layer to conform to the shape of the foot sole. The contours of the bottom surface of the support layer project to the top surface of the support layer, providing a custom molded shoe insert that supports, cushions and conforms to the foot of the wearer.

6 Claims, 3 Drawing Sheets

Fig.1a
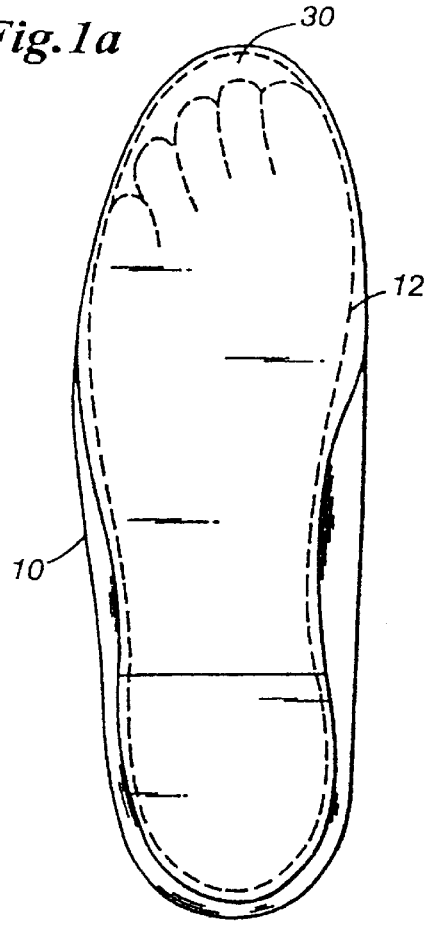
Fig.3
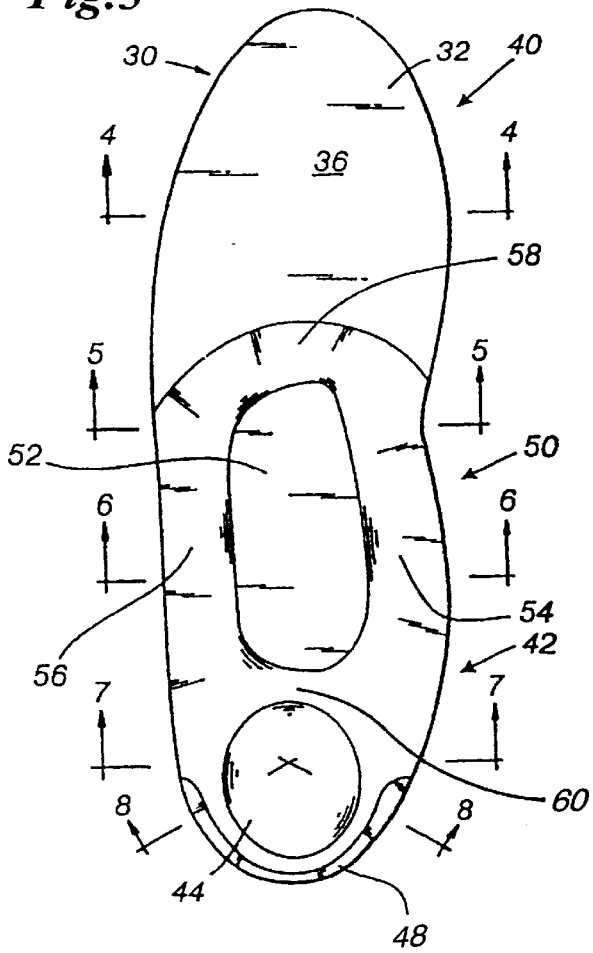
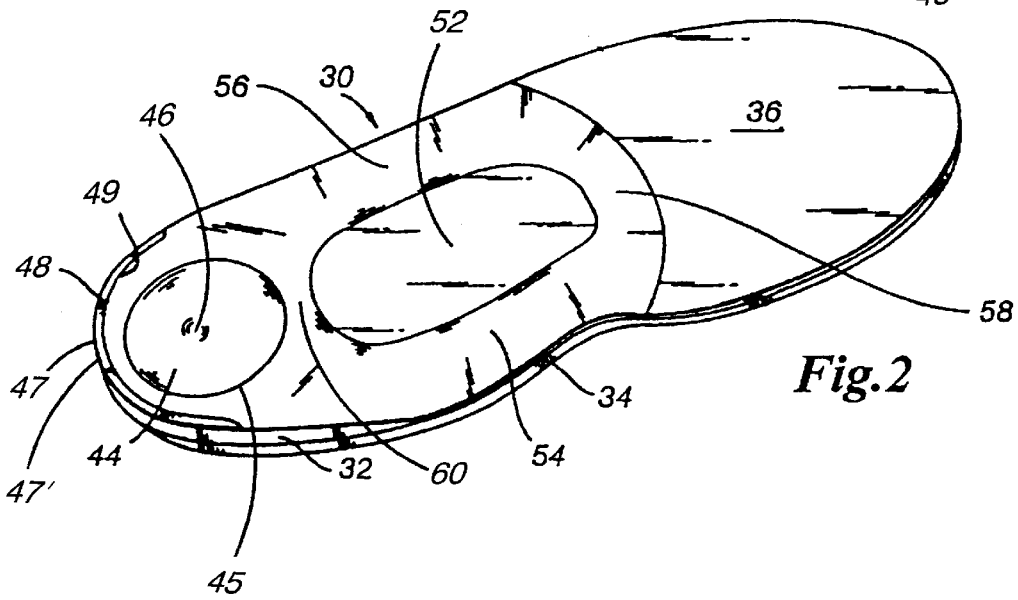
Fig.2

CONFORMABLE SHOE INSERT WITH A SUPPORT LAYER

CROSS-REFERENCE TO RELATED APPLICATION

This application is a continuation-in-part of U.S. patent application Ser. No. 09/087,722, filed May 29, 1998, which is a continuation-in-part of U.S. patent application Ser. No. 08/291,008, filed Aug. 15, 1994, now both abandoned.

FIELD OF THE INVENTION

This invention relates to a shoe insert, or insole, and more particularly, to an orthopaedic shoe insert for providing full-length foot support to a wearer of athletic shoes or shoes with removable inserts.

BACKGROUND OF THE INVENTION

Shoe inserts, or insoles, are widely used to provide cushion, comfort and support to a foot in a shoe. Without the use of shoe inserts, a shoe wearer commonly encounters discomfort in the joints and muscles of the feet, particularly in cases of prolonged wear. Additionally, a shoe wearer may encounter long term health problems, such as chronic back pain resulting from an improper shoe fit, or a lack of sufficient cushion and support in a shoe. For example, normal everyday activity such as walking or running involves repetitive impacts against the shoe wearer's feet. The forces derived from these impacts translate along the shoe wearer's back and spine and out to the rest of the shoe wearer's body and can lead, for example, to back problems for the wearer. A lack of sufficient cushion or support in the shoe increases the risk of such back problems.

An athletic shoe having a proper fit, cushion and support is especially important to an athlete's performance. Depending on the particular activity associated with the athletic shoe, the shoe is designed to withstand pre-determined types and magnitudes of forces. Most activities that involve running, such as soccer, football, baseball and basketball, require that the corresponding athletic shoe properly fit the athlete's foot. For example, soccer cleats should not be too tight around the athlete's feet, yet the feet should not move freely within the soccer cleats. An improperly fitting soccer cleat minimally can cause blisters to form on the foot which negatively impact the wearer's ability to play soccer.

A comfort pad is shown in U.S. Pat. No. 4,862,604 ("the '604 patent"). The comfort pad of the '604 patent includes a generally flat bottom surface and a top surface having an egg shaped depression formed on the top surface of the pad. The comfort pad provides an inexpensive, moisture absorbing pad to be inserted into shoes. However, when used in athletic shoes, the comfort pad of the '604 patent has several disadvantages. Most athletic shoes have a built-in, contoured, removable insert of molded foam material to provide a proper shoe fit. If the comfort pad is placed on top of the built-in insert, it may provide additional comfort, but this depends on the shape, quality, materials and stability of the built-in insert. For example, if the built-in insert is not generally flat, the comfort pad of the '604 patent does not sit correctly in the athletic shoe and actually contributes to the shoe wearer's discomfort. If the built-in insert is removed before adding the comfort pad, the area under the ball of the foot and toes has insufficient padding. The absence of padding or cushioning in the toe box area of the shoe leaves ample shoe space that can adversely affect the fit of the shoe.

The manufacturing of most types of removable athletic shoe inserts is complicated because the process requires placing heat moldable foam material between heated dies to contour the inserts before the inserts are cut to the predetermined shape. Using heated dies is an expensive and labor intensive technique because of the precise machining required of the dies and the requirement of chilling the die-pressed inserts. For example, removable inserts are typically manufactured by molding and contouring the insert under heat and pressure from the heated dies, chilling the insert to set the shape and eventually gluing and assembling additional layers if necessary.

What is needed is a shoe insert that supports and cushions the shoe wearer's foot under a variety of circumstances. More particularly, what is needed is an orthopaedic shoe insert that provides foot support to a wearer of athletic shoes. Further needed is a shoe insert that supports and cushions a shoe wearer's foot and can replace a built-in, contoured or flat, removable insert in a shoe.

What is needed is a shoe insert that provides foot support to a wearer of athletic shoes and that is less complicated and inexpensive to manufacture than conventional shoe pads.

SUMMARY OF THE INVENTION

The invention provides a shoe insert that cushions and supports the shoe wearer's foot under a variety of circumstances. More particularly, the present invention provides an orthopaedic shoe insert that provides foot support to a wearer of athletic shoes. Further, the present invention provides a shoe insert that supports and cushions the shoe wearer's foot and can replace a built-in, contoured, removable insert in a shoe. Further, the present invention provides a shoe insert that provides foot support to a wearer of athletic shoes and that is inexpensive and less complicated to manufacture than conventional shoe inserts.

The shoe insert includes a support layer having a bottom surface and a top surface opposing the bottom surface. The shoe insert further includes a cushion layer fixedly superposed onto the top surface of the support layer. The support layer and the cushion layer each have a perimeter that encompasses the bottom of the foot and the perimeters are substantially identical. When the shoe insert is inserted in the shoe, the bottom surface of the support layer contacts the sole of the shoe. In use, the shoe insert is placed in the shoe with the bottom surface of the support layer contacting the shoe and the cushion layer contacting the foot. When the shoe insert is worn, the foot and weight of the shoe wearer apply pressure to the shoe insert against the shoe. The applied pressure and the natural warmth of the foot cause the contours of the bottom surface of the support layer to project to the top surface of the support layer while the bottom surface is flattened against the shoe. The extent of this projection is limited by the contours of the sole of the foot. The resulting contour of the top surface of the support layer substantially conforms to the contours of the sole of the foot. This projection of the contours provides a custom molded shoe insert that supports, cushions, and conforms to the foot of the shoe wearer.

The bottom surface of the support layer includes a generally planar distal portion, a proximal portion and a medial portion interconnecting the distal portion and the proximal portion. The average thickness of the medial portion and the proximal portion are each greater than the average thickness of the distal portion, and the medial portion is preferably about twice as thick as the distal portion. The distal portion cushions the toes and the ball of the foot. The proximal portion supports the heel of the foot and has a centrally disposed concave depression and a generally planar border located posteriorly with respect to the centrally disposed concave depression. The footwise length of the centrally disposed concave depression is generally greater than the width of the centrally disposed concave depression. When using the shoe insert, the centrally disposed concave depression and border together create a medial and lateral wedging effect against the heel of the foot. The medial portion supports the mid-region of the foot.

The medial portion includes a centrally disposed, generally planar raised portion, a first depression for supporting the medial arch of the foot, a second depression for supporting the lateral arch of the foot, and a third depression for supporting the metatarsal arch of the foot. The first depression is located medially with respect to the raised portion. The second depression is located laterally with respect to the raised portion. The third depression is located anteriorly with respect to the raised portion and interconnects the medial portion to the distal portion.

In a preferred embodiment, the support layer is made of a semi-rigid, heat moldable, polyethylene/ethylene vinyl acetate co-polymer MICROCEL PUFFS® foam that resists compression, and the cushion layer is made of a resilient, visco-elastic, microcellular polyurethane, cross-linked PORON® foam. In an alternative embodiment of the present invention, the shoe insert includes a cloth layer that is fixedly superposed onto the top surface of the cushion layer so that the cushion layer interposes the cloth layer and support layer. The cloth layer wicks moisture from the foot and allows the shoe insert to breathe.

OBJECTS OF THE INVENTION

The principal object of the invention is to provide an improved shoe insert that supports and cushions a foot in a shoe.

Another object of the present invention is to provide a shoe insert for athletic shoes which is easier to manufacture than prior shoe inserts.

Another, more particular, object of the present invention is to provide a full-length shoe insert for athletic shoes that does not require heat molding dies or chillers to manufacture the shoe insert.

Another object of the present invention is to provide a full-length shoe insert for athletic shoes that provides superior performance than prior shoe inserts.

Another object of the present invention is to provide a full-length shoe insert which can be designed to produce the predetermined degree of firmness of the shoe insert.

BRIEF DESCRIPTION OF THE DRAWINGS

The foregoing and other objects will become more readily apparent by referring to the following detailed description and the appended drawings in which:

FIG. 1*a* is a bottom plan view of a shoe illustrating a shoe insert positioned in the shoe;

FIG. 2 is a perspective view of a shoe insert in accordance with the present invention;

FIG. 3 is a bottom plan view of the shoe insert of FIG. 2;

DETAILED DESCRIPTION

While the present invention is described in the context of a right-handed shoe configuration, this is merely for convenience of explanation and not intended to be limiting. The present invention applies equally to a left-handed shoe configuration. The present invention may also be suitable for any type of shoe that can incorporate a removable insert in the shoe.

The human foot comprises phalanges or toes, metatarsals which are connected to the phalanges, tarsal bones which are connected to the metatarsals and a heel bone or calcaneus. The tarsal bones include cuneiform bones, a cuboid bone, a navicular bone and a talus or ankle bone. The cuneiform bones are connected to the first, second and third metatarsals. The cuboid bone interconnects the fourth and fifth metatarsals with the calcaneus. The navicular interconnects the cuneiform bones with the talus and rests on the cuboid bone. The talus rests on the calcaneus.

Figure 1B:
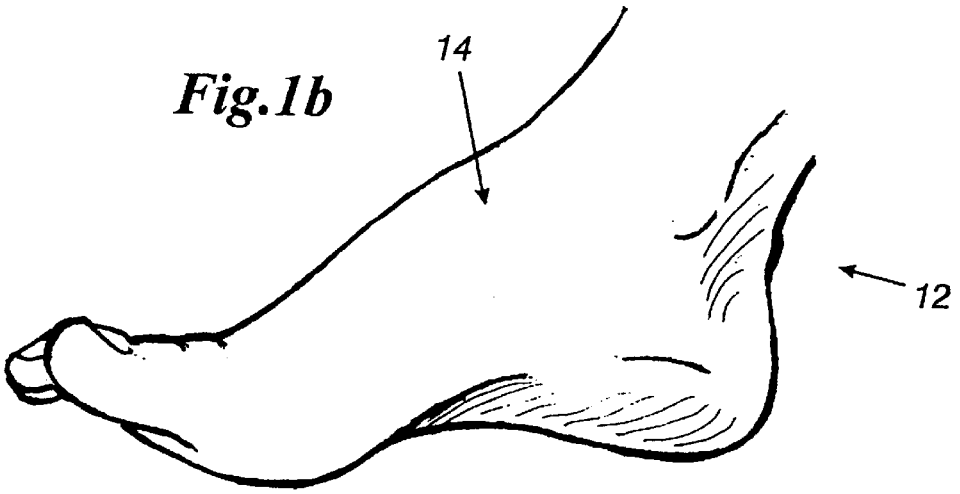
FIG. 1*b* is an elevational view of a human foot.
Figure 1C:
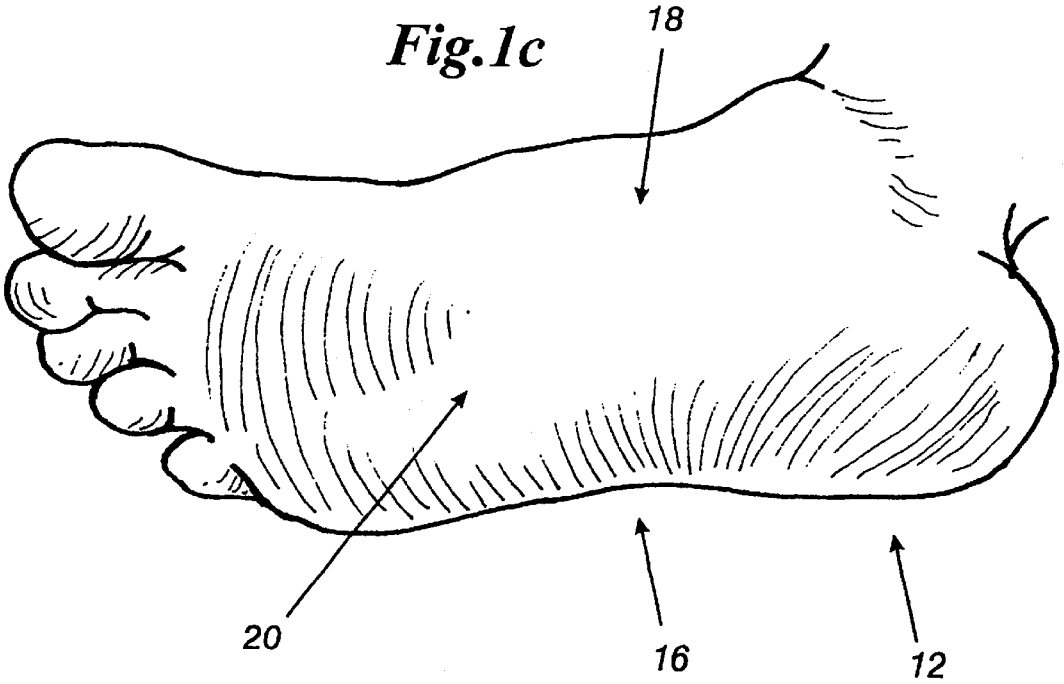
FIG. 1*c* is a perspective view of a human foot showing the sole of the foot in greater detail.

Referring now to the drawings, FIG. 1 a is a bottom plan view of a shoe 10. Within the shoe 10, a shoe insert 30, the outline of which is indicated by broken lines, is insertable to provide comfort, cushion and support to a wearer's foot 12, the outline of which is also indicated by broken lines. FIG. 1*b* is an elevation view of the foot 12, and FIG. 1*c* is a perspective view of the foot 12 showing the sole of the foot in greater detail.

As a whole, the foot 12 forms a generally hemispherical arc about the mid-region 14 of the foot. The mid-region 14 of the foot includes the cuneiform bones, the cuboid bone, the navicular, at least a portion of the calcaneus and at least a portion of the metatarsals. The fifth metatarsal, the cuboid and the calcaneus bones form an outer longitudinal arch or lateral arch, shown generally at 16. At times, the fourth metatarsal bone is included in the lateral arch 16. The first metatarsal, the cuneiform bones, the navicular, the talus and the calcaneus bones form an inner longitudinal arch or medial arch, shown generally at 18. The second metatarsal and the third metatarsal bones may also be included in the medial arch 18. The metatarsal heads form a transverse arch, shown generally at 20. The lateral arch 16, medial arch 18 and transverse arch 20 aid the foot 12 in supporting the weight of a person.

Figure 4:
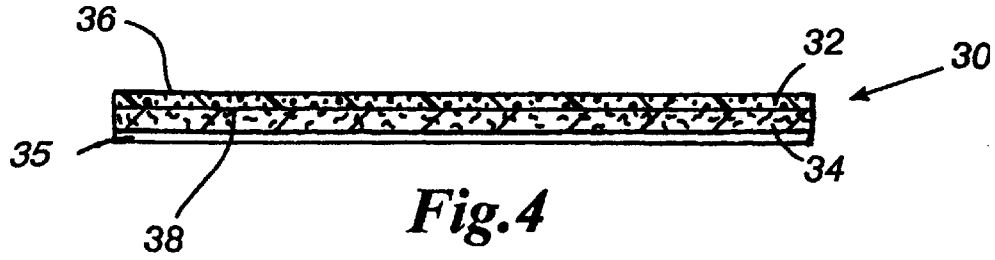
FIG. 4 is a sectional view taken along line 4—4 of FIG. 3.

FIG. 2 is a perspective view of the shoe insert 30 in the inverted orientation. The shoe insert 30 includes a support layer 32, having a first perimeter 47', and a cushion layer 34 fixedly superposed onto the support layer. In an alternative embodiment, the shoe insert 30 further includes a cloth layer 35 (FIGS. 4, 5, 6, 7 and 8) that is fixedly superposed onto the cushion layer 34 so that the cushion layer 34 is interposed between the cloth layer and the support layer 32. In a preferred embodiment, the support layer 32 and the cushion layer 34 are pre-formed together, such as by conventional lamination or adhesion techniques. The support layer 32 and the cushion layer 34 each have a perimeter that encompasses the length and the width of the foot 12. As best shown in FIG. 4, the support layer 32 includes a bottom surface 36 and a top surface 38 generally opposing the bottom surface. The support layer 32 is made of a semi-rigid, heat moldable material that resists compression yet selectively deforms to correspond with the contours of the sole of the foot. In a preferred embodiment of the present invention, the support layer 32 is a semi-rigid, heat moldable, polyethylene/ethylene vinyl acetate (EVA), such as MICROCEL PUFF® fine-cell, cross-linked, polyethylene foam.

In use, the shoe insert 30 is placed in the shoe 10 with the bottom surface 36 of the support layer 32 contacting the shoe and the cushion layer 34 contacting the foot 12. When the shoe insert 30 is worn, the foot 12 and weight of the shoe wearer apply pressure to the shoe insert 30 against the shoe 10. The applied pressure and the natural warmth of the foot 12 cause the contours of the bottom surface 36 of the support layer 32 to project to the top surface 38 of the support layer 32 while the bottom surface 36 is flattened against the shoe 10. The extent of this projection is limited by the contours of the sole of the foot 12. The resulting contour of the top surface 38 of the support layer 32 substantially conforms to the contours of the sole of the foot 12. This projection of the contours provides a custom molded shoe insert 30 that supports, cushions and conforms to the foot of the shoe wearer. Alternatively, the shoe insert 30 may be heated as desired, for example by a conventional hot air blower or convection oven, to accelerate the conformance of the insert 30 to the shape of the foot.

FIG. 3 is a bottom plan view of the shoe insert 30. The bottom surface 36 of the support layer 32 comprises a distal portion, shown generally at 40, that is positioned adjacent the toes and ball of the foot 12, a proximal portion, shown generally at 42, that is positioned adjacent the heel of the foot 12 and a medial portion, shown generally at 50, that interconnects the distal portion 40 and the proximal portion 42 and is positioned adjacent the mid-region 14 of the foot 12. The distal portion 40 cushions the toes and the ball of the foot 12. The proximal portion 42 supports the heel of the foot 12. The medial portion 50 supports the mid-region 14 of the foot 12. The arches 16, 18, 20 have a tendency to be obliterated or flattened to various degrees when the foot is weight-bearing. By associating the different regions of the foot 12 with the corresponding portions 40, 42, 50 of the bottom surface 30 of the support layer 32 of the shoe insert 30, the shoe insert 30 biomechanically aids the foot 12 by limiting the degree to which the arches 16, 18, 20 flatten when weight-bearing, such as during the gait cycle of a walking or running stride.

Figure 5:
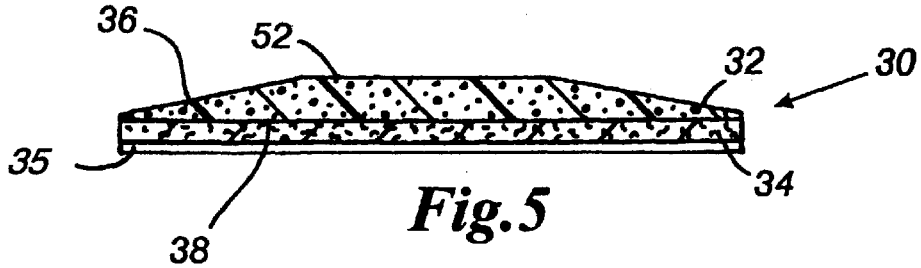
FIG. 5 is a sectional view taken along line 5—5 of FIG. 3.

FIG. 4 is a sectional view of the shoe insert 30 taken along line 4—4 of FIG. 3 through the distal portion 40, and FIG. 5 is a sectional view of the shoe insert 30 taken along line 5—5 of FIG. 3 through the medial portion 50. The distal portion 40 is generally planar and has an average thickness that is generally less than the average thickness of either the proximal portion 42 or the medial portion 50. In the direction from the distal portion 40 towards the medial portion 50, the support layer 32 of the shoe insert 30 gradually increases in thickness. The average thickness of the medial portion 50 is preferably about twice as thick as the average thickness of the distal portion 40.

Figure 7:
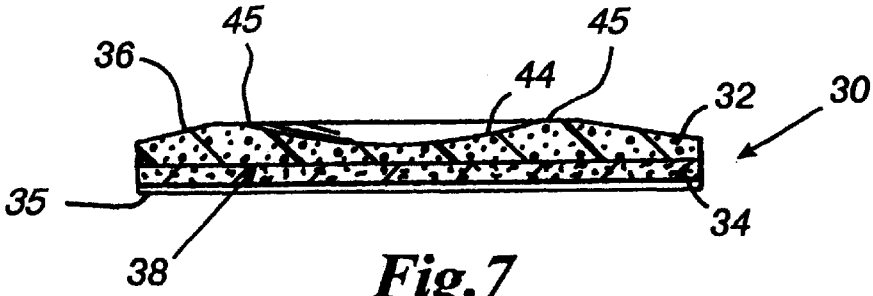
FIG. 7 is a sectional view taken along line 7—7 of FIG. 3.
Figure 8:
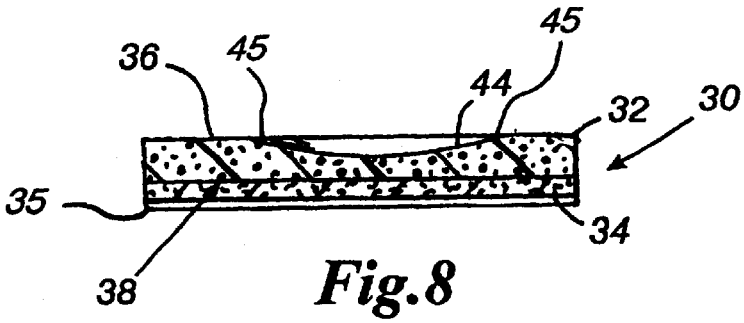
FIG. 8 is a sectional view taken along line 8—8 of FIG. 3.

FIG. 7 is a sectional view of the shoe insert 30 taken along line 7—7 of FIG. 3 through the proximal portion 42, and FIG. 8 is a sectional view of the shoe insert 30 taken along line 8—8 of FIG. 3 through the proximal portion 42. The proximal portion 42 has a centrally disposed concave depression 44 and a generally planar border 48 that is located posteriorly with respect to the centrally disposed concave depression 44. The centrally disposed concave depression 44 of the proximal portion 42 has an outer edge 45 and a generally planar apex 46. The centrally disposed concave depression 44 has a lengthwise dimension and a widthwise dimension corresponding to the length and width, respectively, of the foot 12. The lengthwise dimension of the centrally disposed concave depression 44 is preferably greater than the widthwise dimension of the centrally disposed concave depression 44. The planar border 48 has an outer perimeter 47 that is coextensive with a proximal portion 42 of the perimeter of the shoe insert 30 and also coextensive with the first perimeter 47' of the support layer 32 and an inner perimeter 49 that is adjacent to the centrally disposed concave depression 44.

As the shoe wearer applies pressure on the cushion layer 34 of the shoe insert 30, the centrally disposed concave depression 44 and the border 48 produce a medial and lateral wedging effect against the heel of the foot 12. The combination of the centrally disposed concave depression 44 and the border 48 provides support to the foot 12 so that excessive pronation or excessive supination of the foot 12 is minimized. This is particularly useful in preventing injuries to the ankle during activities, for example basketball or soccer, that require continuous foot movement and tend to cause excessive pronation and supination of the foot.

Figure 6:
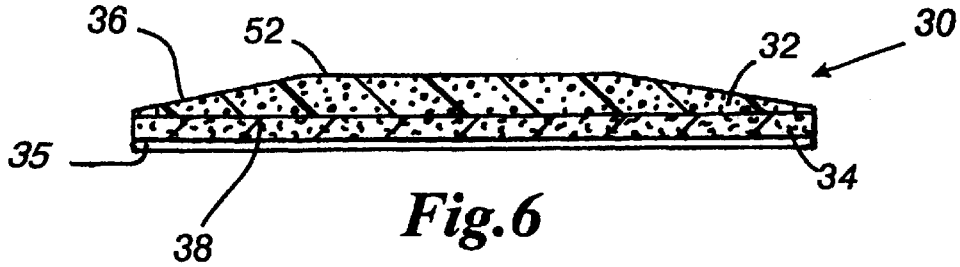
FIG. 6 is a sectional view taken along line 6—6 of FIG. 3.

FIG. 6 is a sectional view of the shoe insert 30 taken along line 6—6 of FIG. 3 through the medial portion 50. The medial portion 50 comprises a centrally disposed raised portion 52, a first depression 54 that is located medially with respect to the raised portion 52, a second depression 56 that is located laterally with respect to the raised portion 52, a third depression 58 that is located anteriorly with respect to the raised portion 52 and a fourth depression 60 that is located posteriorly with respect to the raised portion 52. The raised portion 52 is generally planar and creates support for the generally hemispherical arc about the mid-region 14 of the foot 12. In addition, the raised portion 52 of the medial portion 50 is coplanar with and about the same thickness as the generally planar border 48 of the proximal portion 42. The medial portion 50 is beveled from the raised portion 52 to the first depression 54, the second depression 56, the third depression 58 and the fourth depression 60. The first depression 54 supports the medial arch 18. The second depression 56 supports the lateral arch 16. The third depression 58 supports the transverse arch 20 and interconnects the medial portion 50 with the distal portion 40. The fourth depression 60 interconnects the raised portion 52 of the medial portion 50 with the outer edge 45 of the centrally disposed concave depression 44 of the proximal portion 42. The fourth depression 60 also interconnects the inner perimeter 49 of the generally planar border 48 of the proximal portion 42 with the outer edge 45 of the centrally disposed concave depression 44 of the proximal portion 42. The generally planar apex 46 of the centrally disposed concave depression 44 of the proximal portion 42 is coplanar with and about the same thickness as the bottom surface 36 of the distal portion 40.

When the shoe insert 30 is inserted into the shoe 10, the first depression 54 is positioned adjacent the medial arch 18 of the foot 12, the second depression 56 is positioned adjacent the lateral arch 16 of the foot 12 and the third depression 58 is positioned adjacent the transverse arch 20 of the foot 12.

The cushion layer 34 is uniform in thickness. As previously mentioned, the cushion layer 34 is superposed onto the top surface 38 of the support layer 32, and is made of a resilient cushioning material. Preferably, the cushion layer 34 is made of a resilient, visco-elastic, microcellular polyurethane, cross-linked Poron®. In an alternative embodiment of the present invention, as previously mentioned, a suede-like cloth layer (not shown), such as savoir suede, is provided on the side of the cushion layer 34 that contacts the underside, or sole, of the foot 12. The cloth layer is uniform in thickness, breathable and wicks moisture away from the foot 12.

In a preferred embodiment of manufacturing the shoe insert 30, full length insoles are cut from a sheet of laminated material including the cushion layer 34, the support layer 32 and the cloth layer. Material is then removed by machining or other such post-lamination process from the support layer 32 of the cut insoles to form the distal portion 40, medial portion 50 and the proximal portion 42. Heated dies may, but are typically not used in the manufacture of the shoe insert 30. Because material is removed only from the support layer 32, the invented shoe insert 30 does not require additional grinding and fitting to adapt to normal foot contours and is thus economical and efficient to manufacture.

SUMMARY OF THE ACHIEVEMENT OF THE OBJECTS OF THE INVENTION

From the foregoing, it is readily apparent that I have invented an improved shoe insert that supports and cushions a foot in a shoe. The present invention provides a shoe insert for athletic shoes which is easier to manufacture than prior shoe inserts. The present invention particularly provides a shoe insert for athletic shoes that does not require heat molding dies or chillers. The present invention provides a shoe insert for athletic shoes which provides superior performance than prior shoe inserts. The present invention provides a shoe insert which can be designed to produce the predetermined degree of firmness of the shoe insert.

It is to be understood that the foregoing description and specific embodiments are merely illustrative of the best mode of the invention and the principles thereof, and that various modifications and additions may be made to the apparatus by those skilled in the art, without departing from the spirit and scope of the invention, which is therefore understood to be limited only by the scope of the appended claims.

What is claimed is:

1. A shoe insert that conforms to the contours of the sole of a wearer's foot during use, said shoe insert comprising:

a support layer having a perimeter that encompasses the foot, said support layer comprising:

a generally planar distal portion for cushioning the toes and the ball of the foot;

a proximal portion for supporting the heel of the foot, said proximal portion comprising:

a concave depression having an outer edge and a generally planar apex, said concave depression centrally disposed within said proximal portion; and a generally planar border posteriorly located with respect to said centrally disposed concave depression; and a medial portion interconnecting said distal portion and said proximal portion for supporting the mid-region of the foot, said medial portion comprising:

a generally planar raised portion centrally disposed within said medial portion;

a first depression for supporting the medial arch of the foot, said first depression medially located with respect to said raised portion;

a second depression for supporting the lateral arch of the foot, said second depression laterally located with respect to said raised portion;

a third depression for supporting the transverse arch of the foot, said third depression anteriorly located with respect to said raised portion; and a fourth depression interconnecting said planar raised portion and said centrally disposed concave depression, said fourth depression also interconnecting said generally planar border and said centrally disposed concave depression.

2. A shoe insert according to claim 1 further comprising:

a cushion layer fixedly superposed onto said support layer, said cushion layer having a perimeter that encompasses the foot.

3. A shoe insert according to claim 2 further comprising a cloth layer fixedly superposed onto said cushion layer, wherein said cloth layer is breathable and wicks moisture away from the foot.

4. A shoe insert according to claim 1 wherein said support layer is made of a semi-rigid heat moldable polyethylene/ethylene vinyl acetate (EVA) co-polymer foam.

5. A shoe insert according to claim 1 wherein said medial portion is about twice as thick as said distal portion.

6. A shoe insert according to claim 1 wherein said generally planar border of said proximal portion is coplanar with and about the same thickness as said generally planar raised portion of said medial portion.

* * * * *